US007738815B2

(12) United States Patent
Hirota

(10) Patent No.: US 7,738,815 B2
(45) Date of Patent: Jun. 15, 2010

(54) IMAGE FORMING APPARATUS INCLUDING A TONER DISCHARGE OPERATION

(75) Inventor: Akira Hirota, Okazaki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 129 days.

(21) Appl. No.: 12/034,232

(22) Filed: Feb. 20, 2008

(65) Prior Publication Data

US 2008/0212988 A1 Sep. 4, 2008

(30) Foreign Application Priority Data

Feb. 20, 2007 (JP) ..... 2007-039370

(51) Int. Cl.
*G03G 15/01* (2006.01)
*G03G 15/08* (2006.01)

(52) U.S. Cl. ..... 399/257; 399/27

(58) Field of Classification Search ..... 399/257, 399/27, 149, 150, 28, 29
See application file for complete search history.

(56) References Cited

U.S. PATENT DOCUMENTS 7,418,223 B2 * 8/2008 Suzuki ..... 399/149
2004/0170441 A1 * 9/2004 Forbes et al. ..... 399/27
2005/0025526 A1 * 2/2005 Takahashi et al. ..... 399/257
2007/0253742 A1 * 11/2007 Maeshima et al. ..... 399/257

FOREIGN PATENT DOCUMENTS

| | | |
|---|---|---|
| JP | 4-241372 | 8/1992 |
| JP | 2000-181169 | 6/2000 |
| JP | 2001-188394 | 7/2001 |
| JP | 2001-337503 | 12/2001 |
| JP | 2004-45700 | 2/2004 |

OTHER PUBLICATIONS

Machine translation of JP 2001-337503 A dated Sep. 15, 2009.*
Japanese Office Action mailed on Dec. 2, 2008 directed towards counterpart foreign application No. 2007-039370; 6 pages.

* cited by examiner

*Primary Examiner*—Sophia S Chen
(74) *Attorney, Agent, or Firm*—Morrison & Foerster LLP

(57) ABSTRACT

The level of toner color mixture in a developing device is maintained within the range not affecting the color shade of a final color image. In an image forming apparatus including four imaging units and placed along a moving intermediate transfer body, the imaging units having developing devices for developing an electrostatic latent image formed on a photoconductor to create a toner image and for collecting toner remaining on the photoconductor after transfer of the toner image, the developing device in the imaging unit performs forcible toner discharge operation when a toner mixture amount in the developing device of the imaging unit, which was computed from toner consumption of the imaging unit located on an upstream side, exceeds a predetermined value.

5 Claims, 3 Drawing Sheets

IMAGE FORMING APPARATUS INCLUDING A TONER DISCHARGE OPERATION

RELATED APPLICATION

This application is based on Japanese Patent Application No. 2007-39370, the content of which is incorporated herein by reference.

BACKGROUND OF THE INVENTION

The present invention relates to an image forming apparatus having a plurality of imaging units.

In an electrophotographic image forming apparatus, an electrostatic latent image is formed on the surface of a uniformly charged photoconductor by exposure, and the electrostatic latent image is developed by a developing device to make a toner image, which is transferred to recording media such as recording paper or to intermediate transfer bodies such as intermediate transfer belts. The toner which has remained on the photoconductor after the transfer becomes waste toner if it is scraped and recovered by a cleaner, thus increasing a toner waste. Consequently, a so-called cleanerless process is known in which the residual toner on the photoconductor is adsorbed by a developing roller of the developing to be collected into the developing device so that the toner is provided for recycle.

However, if the cleanerless process is adopted in a tandem-type color image forming apparatus composed of a plurality of imaging units, each of which includes a photoconductor and a developing device and which is parallely placed along an intermediate transfer belt, some toner in the toner image, which was formed with the imaging unit placed in the upstream with respect to the moving direction of the intermediate transfer belt and which was transferred onto the intermediate transfer belt, is reversely transferred onto the photoconductor of an imaging unit located in the downstream so that toner of a different color is collected to the developing device of the imaging unit. This leads to color mixture and ends up causing the adverse influence on the color shade of a final color image.

Accordingly, in order to prevent generation of the color mixture, in JP 2000-181169 A, the toner is not collected in the second and further imaging units from the upstream.

in JP 2001-188394 A, when the image ratio of a toner image formed with an imaging unit on the downstream side is smaller than the image ratio of a toner image formed with an imaging unit on the upstream side, a toner image, which will not be transferred to the recording medium in the end, is formed in the imaging unit on the downstream side and is transferred to the intermediate transfer belt so as to be collected by a cleaner. This allows forcible consumption of the toner with color mixture and allows supply of new toner.

As for JP 2001-188394 A, the color mixture is a phenomenon in which the color mixture rate gradually increases as toner of different colors is mixed inside the developing device. Therefore, high image ratio of an imaging unit on the upstream side does not immediately cause any significant change in the color shade of the toner, and even if the image ratio of the imaging unit on the downstream side is below the image ratio of the imaging unit on the upstream side, color mixture such as causing change of color shade, which is unacceptable in formed images, may still occur after repeated operations.

SUMMARY OF THE INVENTION

An object of the present invention to provide a tandem-type color image forming apparatus which adopted the cleanerless process, in which the level of color mixture in the developing device can be kept in the allowable range.

In order to accomplish the above object, in a first aspect of the present invention, there is provided an image forming apparatus including a plurality of imaging units placed along a moving intermediate transfer body, the imaging units having developing devices for developing an electrostatic latent image formed on a photoconductor to create a toner image and for collecting toner remaining on the photoconductor after transfer of the toner image, wherein the developing device in one of the imaging units performs forcible toner discharge operation when a toner mixture amount in the developing device of the one imaging unit, which was computed from toner consumption of another imaging unit located on an upstream side with respect to a moving direction of the intermediate transfer body, exceeds a predetermined value.

In the image forming apparatus in the first aspect of the present invention, a cleaning section may be placed in contact with the intermediate transfer body, and the toner which was forcibly discharged from the developing device and was transferred onto the intermediate transfer body may be collected by the cleaning section.

In the image forming apparatus in the first aspect of the present invention, when image formation operation of two or more sheets is performed in succession, forcible toner discharging operation is performed after the successive image formation operation.

In the image forming apparatus in the first aspect of the present invention, while the forcible toner discharge operation is performed, a developing bias applied to the developing device is preferably changed to a bias oriented for moving the toner to the photoconductor from the developing device.

There is provided an image forming apparatus, in a second aspect of the present invention, including a plurality of imaging units placed along a moving intermediate transfer body, the imaging units having developing devices for developing an electrostatic latent image formed on a photoconductor to create a toner image and for collecting toner remaining on the photoconductor after transfer of the toner image, a first counter that counts toner consumption in a first imaging unit out of the imaging units, a second counter which counts toner consumption in a second imaging unit placed on a downstream side of the first imaging unit with respect to a moving direction of the intermediate transfer body, a control section which controls so that the developing device of the second imaging unit performs forcible toner discharge operation when a toner mixture amount computed from a counted value of the first counter exceeds a predetermined value and which controls that the developing device of the third imaging unit placed on a further downstream side of the second imaging unit performs forcible toner discharge operation when the toner mixture amount computed from each counted value of the first counter and the second counter exceeds a predetermined value.

In the image forming apparatus in the second aspect of the present invention, the control section may have a first memory and a second memory which respectively store a counted value of the first counter, and a third memory which stores a counted value of the second counter, in the second imaging unit, the forcible toner discharge operation may be controlled based on the value stored in the first memory, while in the third imaging unit, the forcible toner discharge operation may be controlled based on the values respectively stored in the second and the third memory, and the first memory may be reset when the second imaging unit performs the forcible toner discharge operation, while the second and the third memory may be reset when the third imaging unit performs the forcible toner discharge operation.

According to the image forming apparatus in the first aspect of the present invention, the developing device in one of the imaging units performs forcible toner discharge operation when a toner mixture amount in the developing device of the one imaging unit, which was computed from toner consumption of another imaging unit located on an upstream side with respect to a moving direction of the intermediate transfer body, exceeds a predetermined value. Consequently, while mixed-color toner decreases in the developing device in the one imaging unit, new toner is supplied and mixed with the existing toner, so that the level of color mixture in the developing device can be maintained within the range not affecting the color shade of the final color image.

Similarly, according to the image forming apparatus in the second aspect of the present invention, the developing device in the second imaging unit is controlled so that the forcible toner unload operation is performed when a toner mixture amount computed from the toner consumption of the first imaging unit in the upstream thereof exceeds the predetermined value, and the developing device of the third imaging unit is controlled so that the forcible toner unload operation is performed when a toner mixture amount computed from each toner consumption of the first and the second imaging units in the upstream thereof exceeds the predetermined value. Consequently, while mixed-color toner decreases in each developing device in the second and the third imaging units, new toner is supplied and mixed with the existing toner, so that the level of color mixture in each developing device can be maintained within the range not affecting the color shade of the final color image.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

Figure 1:
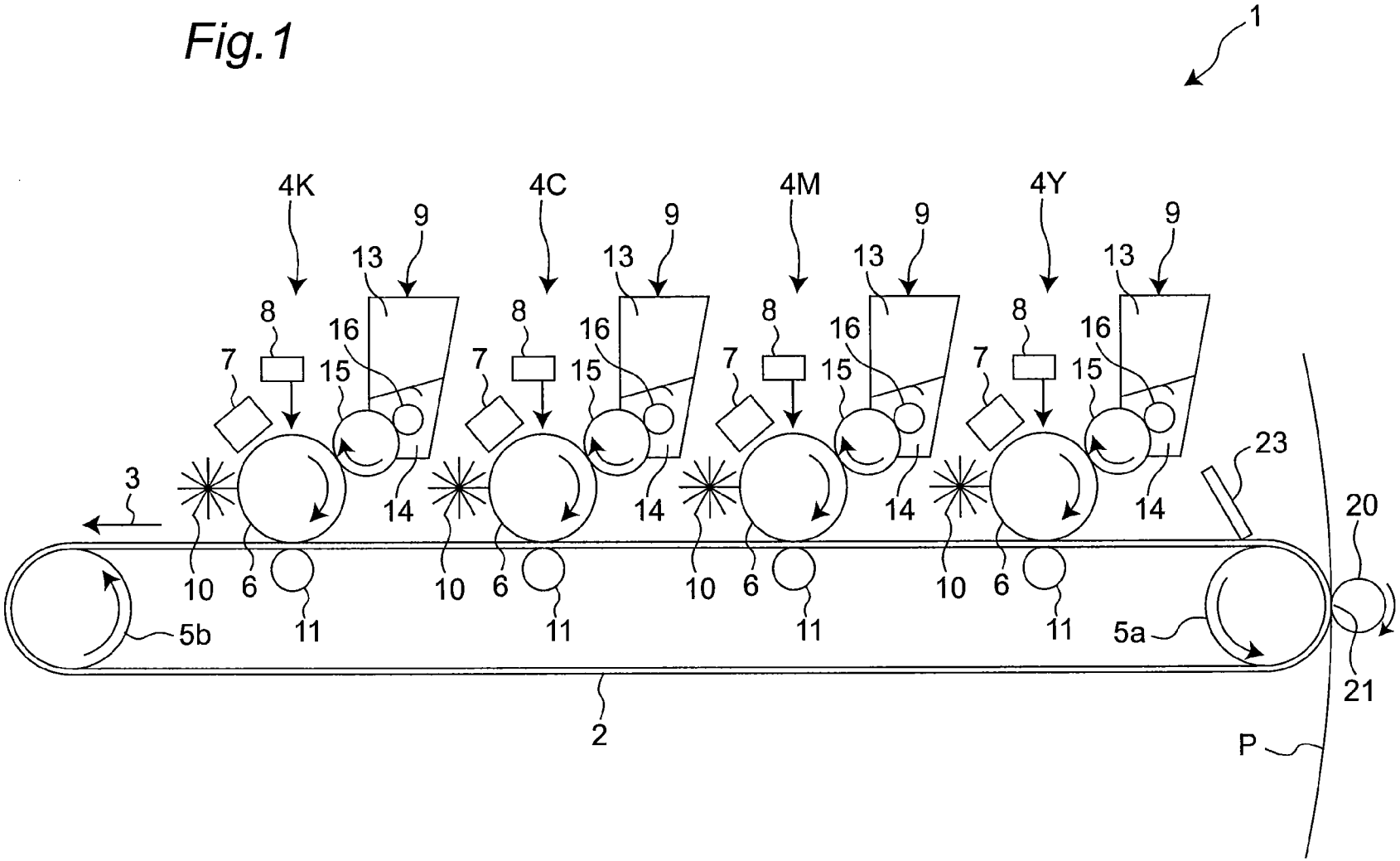
FIG. 1 is a schematic view showing the structure of important sections of an image forming apparatus in one embodiment of the present invention.

FIG. 1 is a schematic view showing the important sections of a tandem-type color image forming apparatus 1 in one embodiment of the present invention. The image forming apparatus 1 has an intermediate transfer belt (intermediate transfer body) 2 in the approximate center inside the device. The intermediate transfer belt 2 in the shape of an endless sheet is stretched over each peripheral part of two rollers 5*a*, 5*b* placed inside thereof, and is rotationally moved in the arrow 3 direction when, for example, the roller 5*a* is rotated by a motor (unshown). The intermediate transfer body may be in the shape of a drum.

Along the upper part of the intermediate transfer belt 2 extending to the horizontal direction, four imaging units 4Y, 4M, 4C, and 4K respectively corresponding to each color toner of yellow (Y), magenta (M), cyan (C) and black (K) are parallely arranged in sequence at prescribed intervals in the horizontal direction from the upstream side of the moving direction of the intermediate transfer belt 2.

The imaging units 4Y, 4M, 4C, and 4K respectively include: a drum-like photoconductor 6; a charger 7 which uniformly charges the surface of the photoconductor 6; an exposure device 8 which exposes the surface of the uniformly charged photoconductor 6 to form an electrostatic latent image; a developing device 9 which develops an electrostatic latent image with toner to form a toner image; and an adjustment brush 10 which adjusts the electric charge of the toner remaining on the photoconductor 6 after the toner image is transferred to the intermediate transfer belt. The photoconductor 6 in each of the imaging units 4Y, 4M, 4C, and 4K is in contact with the intermediate transfer belt 2. Corresponding to each of the imaging units 4Y, 4M, 4C, and 4K, four primary transfer rollers 11 are rotatably provided in the state of sandwiching the intermediate transfer belt 2 with the photoconductors 6.

Each of the developing devices 9 has a storage chamber 13 for storing new toner supplied from an unshown toner bottle and a feed chamber 14 having a function of supplying toner which has been supplied from the storage chamber 13 to the photoconductor 6. The feed chamber 14 has a developing roller 15 which rotates while supporting the toner on the surface so as to take out the toner to the outside of the feed chamber 14 and to supply it to the photoconductor 6, and a feed roller 16 which plays the role of supplying the toner to the developing roller 15 while stirring the toner inside the feed chamber 14 to achieve uniformity.

The adjustment brush 10, which is charged with bias voltage, temporarily collects the toner remaining on the photoconductor 6 after the transfer at the time of image formation, while discharging the toner, which was collected during an image waiting period between an image and a subsequent image, onto the photoconductor 6. The discharged toner is then adsorbed by the developing roller 15 by potential difference (fogging preventing bias voltage) between the photoconductor 6 and the developing roller 15 before being collected into the feed chamber 14.

The portion currently supported by a roller 5*a* of the intermediate transfer belt 2 is removably put in tight contact with a secondary transfer roller 20, and a contact section between the intermediate transfer belt 2 and the secondary transfer roller 20 constitute a secondary transfer section 21. Above the roller 5*a*, a cleaning blade (cleaning section) 23 is placed in contact with the intermediate transfer belt 2 for scraping and collecting the toner remaining on the intermediate transfer belt 2 after the secondary transfer of the toner image.

Figure 2:
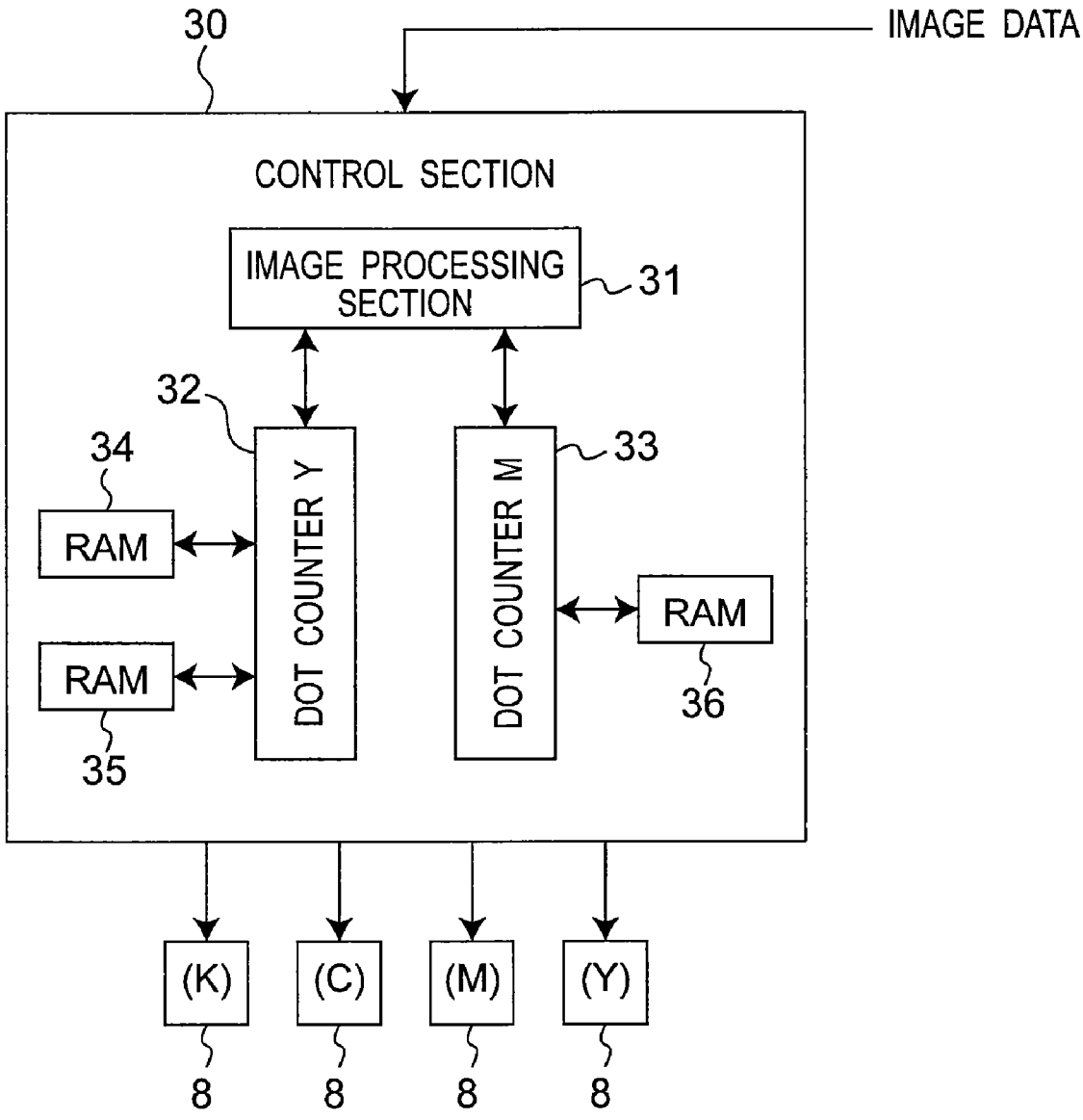
FIG. 2 is a block diagram showing a control unit of the image forming apparatus.

The image forming apparatus 1 has a control section 30 as shows in FIG. 2. Upon input of image data, for example from a document reading section or an external device (e.g., personal computer) attached to the image forming apparatus, a control section 30 resolves the image data to image data of colors, yellow, magenta, cyan, and black by an image processing section 31, and transmits each data to the respective exposure devices 8 of the imaging devices 4Y, 4M, 4C and 4K.

The control section 30 has a yellow dot counter 32, and a magenta dot counter 33. The dot counter 32 counts the number of dot shape potential damping parts which constitute an electrostatic latent image formed on the photoconductor 6 in the imaging unit 4Y. The dot counter 33 counts the number of dot shape potential damping parts which constitute an electrostatic latent image formed on the photoconductor 6 in the imaging unit 4M. Since the electrostatic latent image on the photoconductor 6 is constituted as a set of the dot shape potential damping parts which are formed by applying dot light, corresponding to the image data, from a luminous source (e.g., LED) of the exposure device 8 to the surface of the uniformed charged photoconductor 6, the number of dots forming the electrostatic latent image is equal to the number of luminescence driving pulses of the luminous source included in the image data. Therefore, each of the dot counters 32 and 33 can count the dot number which constitutes the electrostatic latent image by counting luminescence drive pulses included in the yellow image data and the magenta image data which are each acquired from the image processing portion 31.

Further, the control section 30 has a RAM (first memory) 34 and a RAM (second memory) 35 into which a counted value of the dot counter 32 is added and stored, and a RAM (third memory) 36 into which a counted value of the dot counter 33 is added and stored. The stored value in each of the RAMs 34, 35, and 36 is reset to 0 at predetermined time as described later.

Next, description will be given of the image formation operation of the image forming apparatus 1 structured as described above.

Upon reception of a print signal and image data from, for example, a personal computer, image formation operation will be started. In the case of the color image, the image data is divided into image data of each color by the control section 30 before being inputted into each of the exposure devices 8.

In each of the imaging units 4Y, 4M, 4C, and 4K, when the surface of the photoconductor 6 being rotated to the clockwise direction in FIG. 1 is uniformly charged by the charger 7 and then exposed by the exposure device 8 according to the image data of each color, an electrostatic latent image is formed. Then, the electrostatic latent image is developed by the developing device 9 and turns into a toner image. Each toner image formed on the photoconductor 6 in each of the imaging units 4Y, 4M, 4C, and 4K, is primarily transferred onto the intermediate transfer belt 2 in the state of being interposed in sequence by the electrostatic adsorbing action of the primary transfer roller 11 with primary transfer bias applied thereto.

In the case where the image data is a monochrome image, only the black imaging unit 4K operates to form a toner image, which is then primarily transferred onto the intermediate transfer belt 2.

Four color toner images primarily transferred onto the intermediate transfer belt 2 reaches the secondary transfer section 21 along with the rotation of the intermediate transfer belt 2. In synchronization with this, recording paper P as a recording medium is introduced into the secondary transfer section 21. Since secondary transfer bias is applied to the secondary transfer roller 20, the four color toner images on the intermediate transfer belt 2 are secondarily transferred onto the recording paper P together by the electrostatic adsorbing action.

When the recording paper P passes a fixing device (unshown) placed above the secondary transfer section 21, its toner image is melted and fixed by the operation of the heat and pressure, and then the recording paper P is discharged into a paper output tray on the upper side of the image forming apparatus.

In such color image formation operation with each imaging unit 4Y, 4M, 4C, and 4K, the toner remaining on the photoconductor 6 after the primary transfer is collected by the adjustment brush 10 before being discharged onto the photoconductor 6. Then, by the operation of an electric field formed by fogging prevention bias voltage applied to the developing roller 15, the toner emitted onto the photoconductor 6 adheres to the developing roller 15 and is collected into the feed chamber 14, where toner is stirred by the feed roller 16 so as to be mixed with the toner in the feed chamber 14.

In the imaging unit 4M located in the second from the upstream side in the moving direction of the intermediate transfer belt 2, the photoconductor 6 is in contact with the intermediate transfer belt 2, so that when the magenta toner image is primarily transferred in the state being interposed on the yellow toner image, some yellow toner (e.g., several percent) will be reversely transferred onto the photoconductor 6 from the intermediate transfer belt 2. The reversely transferred yellow toner is collected into the feed chamber 14 of the developing device 9 together with the magenta toner remaining on the photoconductor 6 after the primary transfer. This causes color mixture. Similarly, in the developing device 9 of the imaging unit 4C located in the third from the upstream side, yellow toner and magenta toner are mixed into cyan toner in the feed chamber 14, which causes color mixture.

It is to be noted that the problem of color mixture does not arise in the imaging unit 4Y located on the most upstream side. As for the imaging unit 4K located on the most downstream side, even if the toner of other three colors is mixed into the black toner in the feed chamber 14 of the developing device 9, no problem arises since the color shade of the final image on the record paper is not affected at all by the mixture.

As color image formation operation is repeated, the level of color mixture in each developing device 9 of the imaging units 4M and 4C gradually advances, which ends up exerting the bad influence on the color shade of a final color image formed in the record paper. Accordingly, in order to suppress the problem of this color mixture, the image forming apparatus 1 of the present embodiment computes a toner mixture amount based on counted values of the dot counters 32 and 33 in the control section 30, and if the mixture amount exceeds a predetermined critical value, then the image forming apparatus 1 controls so as to perform forcible discharge of the toner from the feed chamber 14 in the developing device 9 of the imaging units 4M and 4C.

Here, detailed description will be given of the theory of calculating the mixture amount (or the amount of color mixtures) using counted values of the dot counters in a concrete example.

First, assuming that a toner capacity J of the feed chamber 14 in the developing device 9 is 25 g and a critical rate $K_r$ of the color mixture into the feed chamber 14 is 3%, a critical amount L of the toner of different color mixed into the feed chamber 14 ($=J\times K_f$) becomes 0.75 g, and when the critical amount is exceeded, the forcible toner discharge operation will be performed.

Next, since the toner mixed into the developing device 9 of the imaging unit 4M is yellow toner of the imaging unit 4Y located in the upstream, the mixture amount needs to be computed. In the imaging unit 4Y, if the amount of toner C adhering to the photoconductor 6 is 6 g/m2 and a print rate (or image ratio) D is 5%, then the total toner adhering amount E ($=S\times T\times C\times D$) of the yellow toner image formed on the photoconductor 6 for a color image, which is to be formed in one A4 paper sheet (S:297 mm wide, lT:210 mm long), becomes 0.018711 g.

If transfer efficiency F from the photoconductor 6 to the intermediate transfer belt 2 is 95%, and a toner reverse transfer rate G from the intermediate transfer belt 2 to the photoconductor 6 in the imaging unit 4M is 4%, then the mixture amount H (=E×F×G) of yellow toner which is reversely transferred to the photoconductor 6 in the imaging unit 4M from the intermediate transfer belt 2 and is collected by the developing device 9 becomes 0.000711 g.

Therefore, when the yellow toner amount H mixed into the developing device 9 in the imaging unit 4M, which is added up for every color image formation operation, exceeds the critical amount L of the toner of different color, the forcible toner discharge operation is performed. Here, assuming that the transfer efficiency, the reverse transfer rate and the like do not change so much, the yellow toner amount H mixed into the developing device 9 of the imaging unit 4M can be obtained by multiplying the print rate D by a constant. The print rate D, which is correlated with a counted value by the dot counter 32, is replaceable, and therefore the yellow toner amount H mixed into the developing device 9 of the imaging unit 4M can be computed based on values obtained by adding up the counted value for every image formation operation. Since the counted value by the dot counter 32 correlates also with yellow toner consumption in the imaging unit 4Y, it can be said that the yellow toner amount H mixed into the developing device 9 in the imaging unit 4M is computable based on the yellow toner consumption in the imaging unit 4Y.

Similarly, mixture of other color toner in the imaging unit 4C is now be examined. Yellow toner and magenta toner from the imaging units 4Y and 4M, which are located in the upstream, are mixed into the developing device 9 of the imaging unit 4C. In this case, it should be taken into consideration that the toner amount of the yellow toner image transferred onto the intermediate transfer belt 2 from the imaging unit 4Y is decreased since it was reversely transferred to the photoconductor 6 of the imaging unit 4M before arriving at the position of the imaging unit 4C. Therefore, the amount of yellow toner mixed into the developing device 9 of the imaging unit 4C is considered to be HYx (1-reverse transfer rate [%]). Therefore, the total mixture amount of yellow toner and magenta toner mixed into the developing device 9 in the imaging unit 4 becomes H=HM+HYx (1-reverse transfer rate [%]), and if the value obtained by adding this value exceeds the critical amount L, then the forcible toner discharge operation will be performed.

Next, description is given of the toner discharge amount at the time of the forcible toner discharge operation.

If forcible discharge is performed in the setting that an image with a print rate of D100% (in short, whole surface solid) is formed on A4 paper, then the amount of toner P discharged from the developing device 9 (=S×T×C×D) in one forcible discharge operation becomes 0.37422 g according to the computation based on the above example. In this case, since the toner discharge amount by one toner discharge operation is equivalent to about 50% of the toner mixture critical amount L (0.75 g), it is preferable to forcibly discharge the amount of toner equivalent to toner mixture amount by performing the toner discharging operation twice. It is to be noted that the toner discharged onto the photoconductor 6 from the developing device 9 by the forcible discharge operation is primarily transferred to the intermediate transfer belt 2, and then it is scraped by the cleaning blade 23 and turns into waste toner without being secondarily transferred to the recording medium. In this case, the secondary transfer roller 20 is moved to the position distant from the intermediate transfer belt 2.

Figure 3:
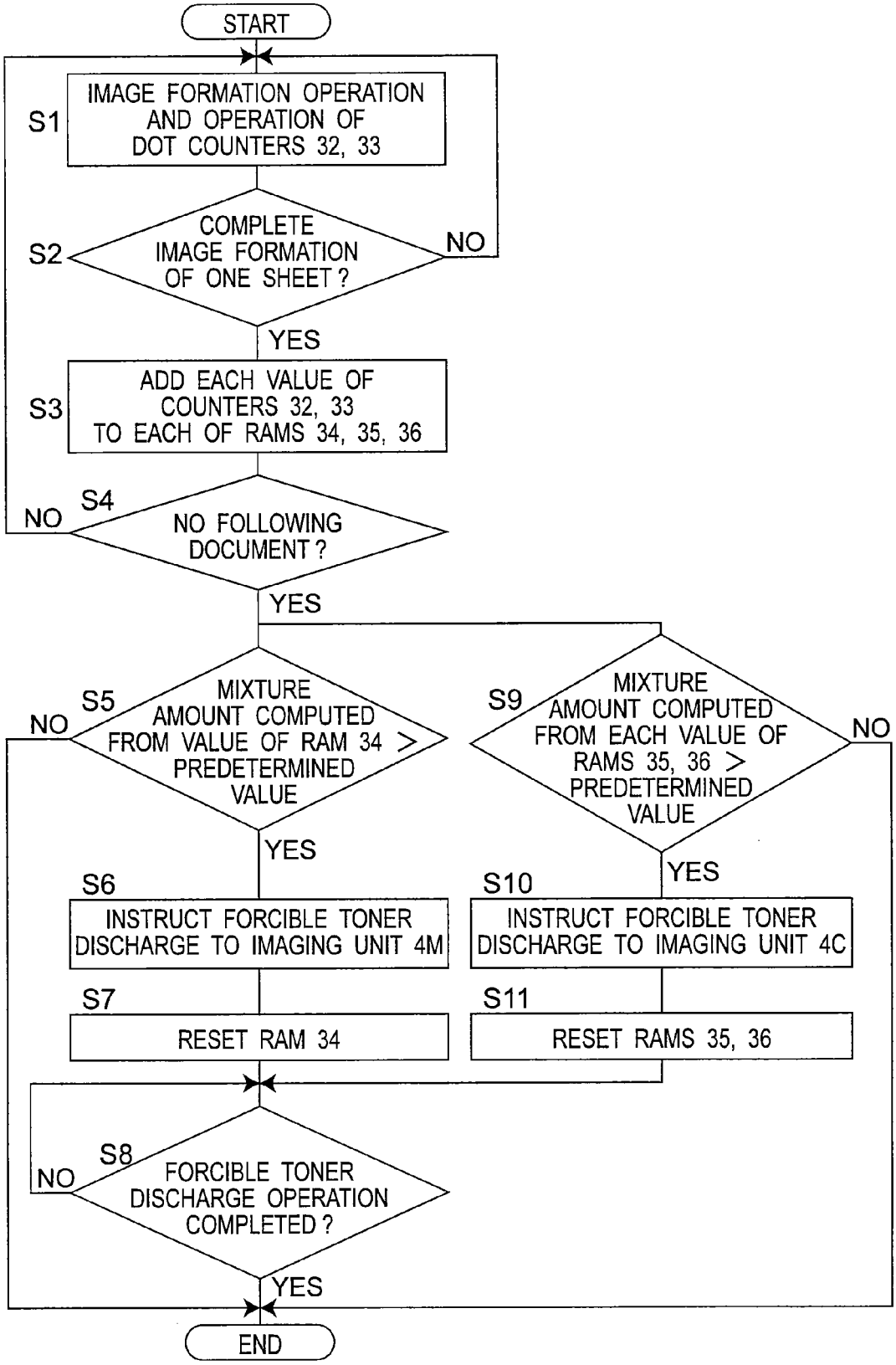
FIG. 3 is a flow chart showing the processing in the control unit.

Next, based on the calculation method for the toner mixture amount and the forcible toner discharge operation, the control in the control section 30 of the image forming apparatus 1 will be described with reference to FIG. 3.

First, upon reception of a print command and color image data, image formation operation as described above is started while the dot counters 32 and 33 are operated (Step S1).

Then after the image formation operation of one sheet is completed (YES at Step 2), a counted value of the yellow dot counter 32 is stored both in the RAMs 34 and 35, and a counted value of the magenta dot counter 33 is stored in the RAM 36 (Step S3).

Next, it is checked whether there is any following image to form (Step S4), and if it exists, then image formation operation will be continued (Step S1), and whenever the image formation operation is completed, each counted value of each dot counters 32 and 33 is added to and stored in the RAMs 34, 35, and 36 in a similar manner.

When the following image to form does not exist (YES at Step S4), then it is determined whether or not the toner mixture amount in the developing device 9 for magenta computed from the counted value of the RAM 34 is over the predetermined value (i.e., the critical amount L) (Step S5), while at the same time, it is determined whether or not the toner mixture amount in the developing device 9 for cyan computed from each counted value in the RAMs 35 and 36 is over the predetermined value (i.e., the critical amount L) (Step S9).

When the toner mixture amount exceeds the predetermined value in the developing device 9 for magenta (YES at Step S5), the imaging unit 4M is made to perform the forcible toner discharge operation (Step S6), the RAM 34 is reset (Step S7), and processing is ended after the forcible toner discharge operation is completed (Step S8). When the toner mixture amount does not exceed the predetermined value (No at Step S5), then processing is ended immediately.

Similarly, in the developing device 9 for cyan, when the toner mixture amount exceeds the predetermined value (YES at Step S9), then the imaging unit 4C is made to perform the forcible toner discharge operation (Step S10), the RAMs 35, 36 are reset (Step S11), and processing is ended after the forcible toner discharge operation is completed (Step S8). When the toner mixture amount does not exceed the predetermined value (No at Step S9), then processing is ended immediately.

It is to be noted that while the forcible toner discharge operation is performed, a developing bias applied to the developing roller 15 of the developing device 9 is changed to a bias oriented for moving the toner to the photoconductor 6 from the developing roller 15. This makes it possible to prevent the forcibly discharged toner from being collected again by the developing device 9.

As mentioned above, according to the image forming apparatus 1 in the present embodiment, the developing devices 9 of the imaging units 4M and 4C out of the four imaging units 4Y, 4M, 4C, and 4K perform the forcible toner discharge operation, when the toner mixture amounts of the developing devices 9 of the imaging units 4M and 4C, which were computed from the toner consumption of the imaging unit 4Y or the imaging units 4Y and 4M on the upstream side with respect to the moving direction of intermediate transfer belt 2, exceed the predetermined value. Consequently, while mixed-color toner decreases in the developing devices 9 of the imaging units 4M and 4C, new toner is supplied and mixed with the existing toner, so that the level of color mixture in the developing devices 9 can be maintained within the range not affecting the color shade of the final color image.

Since the forcible toner discharge operation is performed after the end of the successive image formation operation, it does not prolong image formation time nor cause stress to users.

Although the present invention has been fully described by way of examples with reference to the accompanying drawings, it is to be noted that various changes and modifications will be apparent to those skilled in the art. Therefore, unless otherwise such changes and modifications depart from the spirit and the scope of the present invention, they should be construed as being included therein.

What is claimed is:

1. An image forming apparatus, comprising a plurality of imaging units placed along a moving intermediate transfer body, the imaging units having developing devices for developing an electrostatic latent image formed on a photoconductor to create a toner image and for collecting toner remaining on the photoconductor after transfer of the toner image, wherein the developing device in one of the imaging units performs forcible toner discharge operation when a toner mixture amount in the developing device of the one imaging unit, which was computed from toner consumption of another imaging unit located on an upstream side with respect to a moving direction of the intermediate transfer body, exceeds a predetermined value, and wherein while the forcible toner discharge operation is performed, a developing bias applied to the developing device is changed to a bias oriented for moving the toner to the photoconductor from the developing device.

2. The image forming apparatus according to claim 1, comprising a cleaning section placed in contact with the intermediate transfer body, wherein the toner which was forcibly discharged from the developing device and was transferred onto the intermediate transfer body is collected by the cleaning section.

3. The image forming apparatus according to claim 1, wherein when image formation operation of two or more sheets is performed in succession, forcible toner discharging operation is performed after the successive image formation operation.

4. An image forming apparatus, comprising:

a plurality of imaging units placed along a moving intermediate transfer body, the imaging units having developing devices for developing an electrostatic latent image formed on a photoconductor to create a toner image and for collecting toner remaining on the photoconductor after transfer of the toner image;

a first counter that counts toner consumption in a first imaging unit out of the imaging units;

a second counter which counts toner consumption in a second imaging unit placed on a downstream side of the first imaging unit with respect to a moving direction of the intermediate transfer body; and a control section which controls so that the developing device of the second imaging unit performs forcible toner discharge operation when a toner mixture amount computed from a counted value of the first counter exceeds a predetermined value, and which controls so that the developing device of the third imaging unit placed on a further downstream side of the second imaging unit performs forcible toner discharge operation when a toner mixture amount computed from each counted value of the first counter and the second counter exceeds a predetermined value, wherein while the forcible toner discharge operation is performed, a developing bias applied to the developing device is changed to a bias oriented for moving the toner to the photoconductor from the developing device.

5. The image forming apparatus according to claim 4, wherein the control section has a first memory and a second memory which respectively store a counted value of the first counter, and a third memory that stores a counted value of the second counter, wherein in the second imaging unit, the forcible toner discharge operation is controlled based on the value stored in the first memory, while in the third imaging unit, the forcible toner discharge operation is controlled based on the values respectively stored in the second and the third memory, and wherein the first memory is reset when the second imaging unit performs the forcible toner discharge operation, while the second and the third memory are reset when the third imaging unit performs the forcible toner discharge operation.

* * * * *